US005273099A

United States Patent [19]

Takagi et al.

[11] Patent Number: 5,273,099

[45] Date of Patent: Dec. 28, 1993

[54] COMPOSITE ALUMINUM MEMBER JOINING PROCESS

[75] Inventors: Katumi Takagi, Nagoya; Akinari Ishikawa, Kariya, both of Japan

[73] Assignee: Aisin Seiki Kabushiki Kaisha, Japan

[21] Appl. No.: 835,080

[22] Filed: Feb. 18, 1992

Related U.S. Application Data

[63] Continuation of Ser. No. 514,268, Apr. 25, 1990, abandoned.

[30] Foreign Application Priority Data

May 18, 1989 [JP] Japan ..... 1-125431

[51] Int. Cl.[5] ..... B22C 9/04; B22D 19/04

[52] U.S. Cl. ..... 164/34; 164/98; 164/102; 164/65

[58] Field of Search ..... 164/34, 35, 36, 45, 164/98, 100, 61, 62, 63, 7.1, 7.2, 9, 101, 65

[56] References Cited

U.S. PATENT DOCUMENTS

| | | | |
|---|---|---|---|
| 4,482,000 | 11/1984 | Reuter | 164/45 |
| 4,643,241 | 2/1987 | Yonekura | 164/101 |
| 4,705,092 | 11/1987 | Ito | 164/98 |
| 4,711,288 | 12/1987 | Harvey | 164/34 |
| 4,872,500 | 10/1989 | Duffey | 164/98 |

FOREIGN PATENT DOCUMENTS

| | | | |
|---|---|---|---|
| 1289951 | 2/1969 | Fed. Rep. of Germany | 164/34 |
| 64411 | 11/1982 | Japan | 164/97 |
| 61-033752 | 2/1986 | Japan | 164/101 |
| 62-134161 | 6/1987 | Japan | 164/10 |
| 62-173065 | 7/1987 | Japan | 164/98 |
| 63-49344 | 3/1988 | Japan | 164/34 |
| 63-278661 | 11/1988 | Japan | 164/97 |

OTHER PUBLICATIONS

Application of Cast-On Ferrochrome-Based Hard Surfacings to Polystyrene Pattern Castings, U.S. D.O.I. J. S. Hansen, R. R. Jordan, S. J. Gerdemann, G. F. Soltau.

*Primary Examiner*—Richard K. Seidel
*Assistant Examiner*—Rex E. Pelto
*Attorney, Agent, or Firm*—Banner, Birch, McKie & Beckett

[57] ABSTRACT

A composite aluminum member joining process. A chemical film including potassium and fluorine is formed on an aluminum member or a flux including potassium and fluorine is coated on an aluminum member. The coated aluminum member is buried together with a disposable pattern in a predetermined assembled state in a mold including molding sand. Then, molten aluminum alloy is poured into the mold, thereby molding an aluminum alloy cast member. The mold is decompressed through the molding sand, thereby expelling tar-like substances generated when the disposable pattern comes in contact with the molten aluminum alloy, burns and vaporizes, at least from the boundary surface between the disposable pattern and the molding sand to the molding sand disposed around the disposable pattern and preventing the tar-like substances from interposing between the aluminum member and the aluminum alloy cast member made from the molten aluminum alloy. Thus, the tar-like substances are drawn in by suction and expelled at least from the boundary surface between the disposable pattern and the molding sand to the molding sand disposed around the disposable pattern before they are deposited on the surfaces of the aluminum member. As a result, the tar-like substances do not interpose between the aluminum alloy cast member and the aluminum member coated with the chemical film or the flux. Therefore, the aluminum member and the aluminum alloy cast member are joined completely, because the effects of the chemical film or the flux have not been lost.

14 Claims, 1 Drawing Sheet

COMPOSITE ALUMINUM MEMBER JOINING PROCESS

This application is a continuation of application Ser. No. 07/514,268, filed Apr. 25, 1990, now abandoned.

BACKGROUND OF THE INVENTION

1. Field of the Invention

The present invention relates to a composite aluminum member joining process. The composite aluminum member joining process according to the present invention can be employed in the manufacture of an automobile internal combustion engine. Here, the composite aluminum member means one comprising a member made of a pure aluminum expanded material or an aluminum alloy expanded material and a member made of an aluminum alloy casting joined thereto. Hereinafter, the member made of a pure aluminum expanded material or an aluminum alloy expanded material is simply referred to as an aluminum member, and the aluminum member includes a preformed member, an expanded member, an extruded member and so on made of pure aluminum or aluminum alloys.

2. Discussion of the Prior Art

Since an aluminum member is covered with an oxide film formed closely and strongly thereon, it is therefore very hard to join or weld an aluminum member to a member made of an aluminum alloy casting (or a cast member made from a molten aluminum alloy, hereinafter simply referred to as an aluminum alloy cast member).

It has been known to coat an aluminum member with a flux comprising potassium tetrafluoro aluminate ($KAlF_4$) in advance so as to avoid the difficulty in joining the aluminum member to an aluminum alloy cast member. Further, another method has been proposed in Japanese Unexamined Patent Publication No. 33752/1986, in which a chemical film comprising potassium pentafluoro aluminate ($K_2AlF_5.H_2O$) is formed on an aluminum member, and thereafter the aluminum member is brought into contact with and joined or welded to an aluminum alloy cast member made from a molten aluminum alloy.

These methods have been devised in order to improve the wettability between an aluminum member and a molten aluminum alloy. However, the methods have not been applicable to a casting process employing a disposable pattern, because the disposable pattern generates tar-like substances when it comes in contact with the molten aluminum alloy, burns and vaporizes. The tar-like substances remain on the boundaries between an aluminum member and an aluminum alloy cast member made from a molten aluminum alloy, and accordingly they prevent the molten aluminum alloy from coming in contact with the aluminum member. The tar-like substances thus hinder the joining of an aluminum member and an aluminum alloy cast member made from a molten aluminum alloy.

SUMMARY OF THE INVENTION

It is therefore an object of the present invention to provide a composite aluminum member joining process enabling a complete joining between an aluminum member and an aluminum alloy cast member.

It is a further object of the present invention to provide a composite aluminum member joining process applicable to an aluminum alloy casting process employing a disposable pattern in which an aluminum member and an aluminum alloy cast member made from a molten aluminum alloy are joined by casting.

The above and other objects are carried out by a composite aluminum member joining process according to the present invention comprising the steps of: a first step of forming a chemical film comprising potassium and fluorine on an aluminum member or coating a flux comprising potassium and fluorine on an aluminum member; a second step of burying the aluminum member together with a disposable pattern in a predetermined assembled state in a mold comprising molding sand; and a third step of pouring a molten aluminum alloy into the mold, thereby molding an aluminum alloy cast member; wherein the mold is decompressed through the molding sand of the mold by a means for decompressing the mold in the third step, thereby expelling tar-like substances, generating when the disposable pattern comes in contact with the molten aluminum alloy, burns and vaporizes, at least from the boundary surface between the disposable pattern and the molding sand to the molding sand disposed around the disposable pattern and preventing the tar-like substances from interposing between the aluminum member and the aluminum alloy cast member made from the molten aluminum alloy.

The chemical film may be a potassium pentafluoro aluminate ($K_2AlF_5.H_2O$) film formed by immersing the aluminum member into an aqueous solution of potassium hydrogen fluoride ($KHF_2$), a mixed aqueous solution of potassium fluoride (KF) and hydrogen fluoride (HF), or a mixed aqueous solution of potassium hydroxide (KOH) and hydrogen fluoride (HF), for instance. The flux may be a potassium tetrafluoro aluminate ($KAlF_4$) flux, and coated on the aluminum member in a powder form or a suspension form.

As mentioned earlier, the aluminum member includes a preformed member, an expanded member, an extruded member and so on made of pure aluminum or aluminum alloys. The aluminum alloys may comprise aluminum (Al) and at least one or more of silicon (Si), copper (Cu), manganese (Mn), zinc (Zn), titanium (Ti), chromium (Cr), zirconium (Zr) and magnesium (Mg). The silicon, copper, zinc and magnesium may be added so as to increase the strength. The other components such as the manganese, titanium and chromium may be added for satisfying special requirements. The contents of the components are not particularly specified herein, however, it is preferable to include the magnesium by a lesser content in order not to adversely affect the moldablility or the flowablity.

The disposable pattern and the mold are ordinary ones employed in an ordinary disposable pattern mold casting. The disposable pattern may be made of polyethylene foam, polystyrene foam and the like. The mold may comprise molding frames forming a container opened at the top and molding sand which are the ones usually employed in an ordinary disposable pattern mold casting. The molding sand may be silica sand ($SiO_2$) including clay, synthetic molding sand and the like. The average grain size, the permeablity, the strength and the like of the molding sand, and the hardness of the mold or the amount of ramming of the molding sand may be determined in accordance with the requirements of the respective casting and joining operations.

The molten aluminum alloy may be one having a composition similar to the above-mentioned composition of the aluminum member, and an aluminum alloy having such a composition is melted prior to the pouring.

As for the means for decompressing the mold through the molding sand, an ordinary vacuum pump may be employed. Since the degree of the decompression depends on the respective casting and joining operations, it cannot be specifically set forth herein. However, it is usually preferable to decompress the mold through the molding sand to the vacuum of −400 to −100 mmHg gauge pressure for most of the casting and joining operations.

The operations of the composite aluminum joining process according to the present invention are as follows: First, the aluminum member is coated with the chemical film or the flux comprising potassium and fluorine, and buried together with the disposable pattern in a predetermined assembled state in the molding sand of the mold. Then, the mold is decompressed through the molding sand by the means for decompressing the mold before pouring the molten aluminum alloy, and thereafter the molten aluminum alloy is poured into the mold for molding the aluminum alloy cast member. As a result, the tar-like substances, generating when the disposable pattern comes in contact with the molten aluminum alloy, burns and vaporizes, are expelled at least from the boundary surface between the disposable pattern and the molding sand to the molding sand disposed around the disposable pattern. Thus, the aluminum member coated with the chemical film or the flux and the aluminum alloy cast member made from the molten aluminum alloy can be brought into contact with each other securely, and can be joined together completely.

The advantages of the composite aluminum member joining process according to the present invention will be hereinafter described. The tar-like substances are drawn in by suction and expelled at least from the boundary surface between the disposable pattern and the molding sand to the molding sand disposed around the disposable pattern before they deposit on the surfaces of the aluminum member. Accordingly, the tar-like substances do not come in contact with the aluminum member, and they do not interpose between the aluminum alloy cast member made from the molten aluminum alloy and the aluminum member coated with the chemical film or the flux comprising potassium and fluorine. The effects of the forming or the coating of the chemical film or the flux are not thus adversely affected at all. Therefore, the aluminum member and the aluminum alloy cast member are joined together completely, and the appearance of the finished product also becomes satisfactory.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT OF THE INVENTION

Having generally described the present invention, a further understanding can be obtained by reference to a certain specific preferred embodiment which is provided herein for purposes of illustration only and is not intended to be limiting unless otherwise specified.

Figure 1:
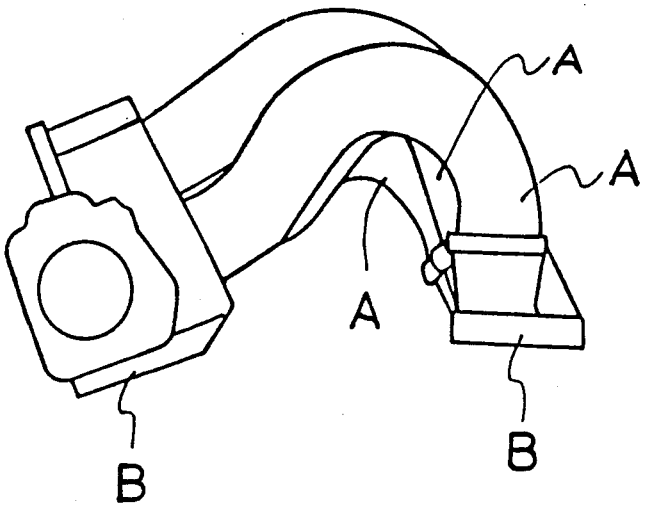
FIG. 1 is a view illustrating an appearance of an intake manifold processed and joined by a preferred embodiment of a composite aluminum member joining process according to the present invention.

FIG. 1 illustrates an intake manifold to be processed and joined by a preferred embodiment of a composite aluminum alloy joining process according to the present invention. The intake manifold includes aluminum members "A" of bent tubular shapes and aluminum alloy cast members "B" of substantially rectangular shapes joined together. In the intake manifold, the aluminum members "A" are disposed in between the aluminum alloy cast members "B," and the aluminum alloy cast members "B" are connected by the aluminum members "A."

Figure 2:
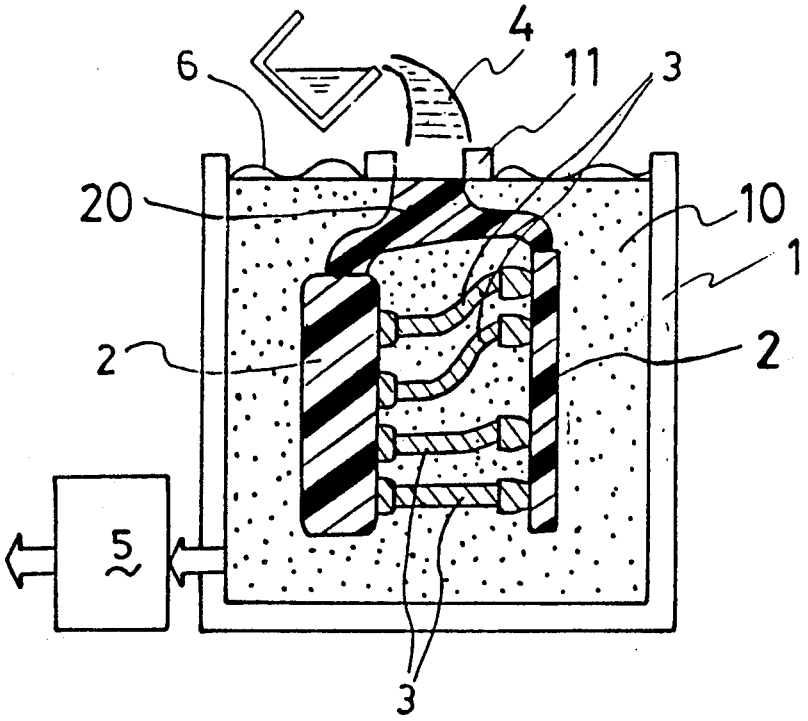
FIG. 2 is an explanatory cross sectional view illustrating a casting apparatus employed in a preferred embodiment of a composite aluminum member joining process according to the present invention.

Turning now to FIG. 2, the figure illustrates a casting apparatus employed by the preferred embodiment of a composite aluminum member joining process according to the present invention. The casting apparatus includes a mold 1 having molding frames forming a container opened at the top, a molding sand 10 rammed into the mold 1, a disposable pattern 2 buried in the molding sand 10, aluminum members 3 disposed in a predetermined assembled state with the disposable pattern 2 and also buried in the molding sand 10, a vacuum pump 5 connected to the molding sand 10 by way of the mold 1 at the bottom, and a vinyl film 6 covering the top of the molding sand 10 in an air-tight manner. Further, a pouring basin 11 is disposed on the molding sand 10 at the top of the mold 1.

The disposable pattern 2 is to be cast into the aluminum alloy cast members "B" as illustrated in FIG. 1. The disposable pattern 2 is one piece with a runner, a gate and a riser, all of which are designated at 20 in FIG. 2, and is made of polyethylene foam. The aluminum members 3 correspond to the aluminum members "A" illustrated in FIG. 1, and are to be joined to the aluminum alloy cast members "B" when the preferred embodiment of the composite aluminum member joining process according to the present invention has been carried out.

The vacuum pump 5 works to draw in the tar-like substances, which generate upon pouring the molten aluminum alloy into the mold 1, by suction and to expel them at least from the boundary surface between the disposable pattern 2 and the molding sand 10 to the molding sand 10 disposed around the disposable pattern 2.

The vinyl film 6 works to enhance the effect of the decompression of the mold 1 by the vacuum pump 5. Hence, it is preferable to take care in order to deliberately seal off the boundary between the inner walls of the mold 1 and the molding sand 10 at the top and the boundary between the pouring basin 11 and the molding sand 10 at the top. In this preferred embodiment, the top of the molding sand 10 including the boundary between the inner walls of the mold 1 and the molding sand 10 at the top and the boundary between the pouring basin 11 and the molding sand 10 at the top were sealed off completely with the vinyl film 6 except the opening of the pouring basin 11.

The thus arranged casting apparatus was employed in the preferred embodiment of the present invention, and the preferred embodiment thereof was carried out as follows: First, the chemical film comprising potassium pentafluoro aluminate ($K_2AlF_5.H_2O$) was formed on the aluminum members 3, or the flux comprising potassium tetrafluoro aluminate ($KAlF_4$) was coated on the aluminum members 3.

The aluminum members 3 thus treated were buried together with the disposable pattern 2 in a predetermined assembled state in the molding sand 10 in the mold 1. After completely burying the disposable pattern 2 and the aluminum members 3, the molding sand 10 was rammed to finish the preparation of the mold 1.

After preparing the mold 1, the top of the molding sand 10 was thoroughly covered with the vinyl film 6 in an air-tight manner, except the opening of the pouring basin 11. Then, the vacuum pump 5 was operated in order to decompress the mold 1 through the molding sand 10 to the vacuum of from −400 to −100 mmHg gauge pressure before pouring a molten aluminum alloy 4 into the mold 1. Thereafter, the molten aluminum alloy 4 was poured into the mold 10 by way of the pouring basin 11 by a predetermined amount, thereby molding the aluminum alloy cast members "A" as illustrated in FIG. 1. Accordingly, the tar-like substances were expelled at least from the boundary surface between the disposable pattern 2 and the molding sand 10 to the molding sand 10 disposed around the disposable pattern 2, though the tar-like substances generated upon pouring the molten aluminum alloy 4, bringing the molten aluminum alloy 4 into contact with the disposable pattern 2 and burning and vaporizing the disposable pattern 2. Thus, the tar-like substances were expelled at least from the boundary surface, and they did not interpose between the aluminum members 3 and the aluminum alloy cast members during the casting and joining operation. As a result, the aluminum members 3 and the aluminum alloy cast members were joined together without failure. The intake manifold as illustrated in FIG. 1 was thus processed and joined by the preferred embodiment of the composite aluminum member joining process according to the present invention.

According to the preferred embodiment of the present invention, the tar-like substances did not interpose between the aluminum alloy cast members and the aluminum members 3 on which the chemical film was formed or the flux was coated, because the tar-like substances were drawn in by suction and expelled at least from the boundary surface between the disposable pattern 2 and the molding sand 10 to the molding sand 10 disposed around the disposable pattern 2 by the action of the vacuum pump 5 before they deposited on the surfaces of the aluminum members 3. Accordingly, the effects of the chemical film forming or the flux coating were maintained. Hence, the aluminum members 3 and the aluminum alloy cast members were joined together completely and made into the intake manifold free from a failure joint as illustrated in FIG. 1. In addition, the appearance of the intake manifold was pleasant.

Having now fully described the invention, it will be apparent to one of ordinary skill in the art that many changes and modifications can be made thereto without departing from the spirit or scope of the invention as set forth herein.

What is claimed is:

1. In a composite aluminum member joining process comprising the steps of burying an aluminum member together with a disposable pattern in a predetermined assembled state in a mold comprising molding sand and pouring a molten aluminum alloy into said mold to mold an aluminum alloy cast member, wherein said molten aluminum alloy contacts, burns and vaporizes said disposable pattern, the improvement comprising:

forming a chemical film comprising potassium and fluorine on said aluminum member or coating a flux comprising potassium and fluorine on said aluminum member before burying said aluminum member;

selecting a vacuum sufficient to expel, from the boundary surface between said molten aluminum alloy and said aluminum member, carbon combustion products generated when said molten aluminum alloy contacts, burns and vaporizes said disposable pattern; and applying said vacuum to said molding sand to expel said carbon combustion products from the boundary surface between said molten aluminum alloy and said aluminum member, such that said aluminum member and said aluminum alloy cast member are joined together to form a joint free of said carbon combustion products, wherein the top surface of said mold is sealed off with a sealing means in said applying step.

2. The composite aluminum member joining process according to claim 1, wherein said chemical film comprises potassium pentafluoro aluminate ($K_2AlF_5.H_2O$).

3. The composite aluminum member joining process according to claim 1, wherein said flux comprises potassium tetrafluoro aluminate ($KAlF_4$).

4. The composite aluminum member joining process according to claim 1, wherein said disposable pattern comprises at least one selected from the group consisting of polyethylene foam and polystyrene foam.

5. The composite aluminum member joining process according to claim 1, wherein said molding sand comprises at least one selected from the group consisting of silica sand ($SiO_2$) including clay, and synthetic molding sand.

6. The composite aluminum member joining process according to claim 1, wherein said aluminum member and said aluminum alloy cast member comprise aluminum (Al) and at least one selected from the group consisting of silicon (Si), copper (Cu), manganese (Mn), zinc (Zn), titanium (Ti), chromium (Cr), zirconium (Zr), magnesium (Mg) and the mixtures thereof.

7. The composite aluminum member joining process according to claim 1, wherein said composite aluminum member joining process is employed in the manufacture of an automobile internal combustion engine.

8. In a composite aluminum member joining process comprising the steps of burying an aluminum member together with a disposable pattern in a predetermined assembled state in a mold comprising molding sand and pouring a molten aluminum alloy into said mold to mold an aluminum alloy cast member, wherein said molten aluminum alloy contacts, burns and vaporizes said disposable pattern, the improvement comprising:

forming a chemical film comprising potassium and fluorine on said aluminum member or coating a flux comprising potassium and fluorine on said aluminum member before burying said aluminum member;

selecting a vacuum sufficient to expel, from the boundary surface between said molten aluminum alloy and said aluminum member, carbon combustion products generated when said molten aluminum alloy contacts, burns and vaporizes said disposable pattern; and applying said vacuum to said molding sand to expel said carbon combustion products from the boundary surface between said molten aluminum alloy and said aluminum member, such that said aluminum member and said aluminum alloy cast member are joined together to form a joint free of said carbon combustion products, wherein said mold is decompressed through said molding sand of said mold to the vacuum of −400 to −100 mmHg gauge pressure in said applying step.

9. The composite aluminum member joining process according to claim 8, wherein said chemical film comprises potassium pentafluoro aluminate ($K_2AlF_5.H_2O$).

10. The composite aluminum member joining process according to claim 8, wherein said flux comprises potassium tetrafluoro aluminate ($KAlF_4$).

11. The composite aluminum member joining process according to claim 8, wherein said disposable pattern comprises at least one selected from the group consisting of polyethylene foam and polystyrene foam.

12. The composite aluminum member joining process according to claim 8, wherein said molding sand comprises at least one selected from the group consisting of silica sand ($SiO_2$) including clay, and synthetic molding sand.

13. The composite aluminum member joining process according to claim 8, wherein said aluminum member and said aluminum alloy cast member comprise aluminum (Al) and at least one selected from the group consisting of silicon (Si), copper (Cu), manganese (Mn), zinc (Zn), titanium (Ti), chromium (Cr), zirconium (Zr), magnesium (Mg) and the mixtures thereof.

14. The composite aluminum member joining process according to claim 8, wherein said composite aluminum member joining process is employed in the manufacture of an automobile internal combustion engine.

* * * * *